US009904235B2

(12) United States Patent
Imanaka et al.

(10) Patent No.: US 9,904,235 B2
(45) Date of Patent: Feb. 27, 2018

(54) CLEANING DEVICE AND IMAGE FORMING APPARATUS

(71) Applicant: KYOCERA Document Solutions Inc., Osaka (JP)

(72) Inventors: Koichi Imanaka, Osaka (JP); Takashi Morita, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/654,107

(22) Filed: Jul. 19, 2017

(65) Prior Publication Data

US 2018/0032025 A1 Feb. 1, 2018

(30) Foreign Application Priority Data

Jul. 28, 2016 (JP) ..... 2016-148956

(51) Int. Cl.

| | |
|---|---|
| ***G03G 21/00*** | (2006.01) |
| ***G03G 21/10*** | (2006.01) |
| ***G03G 15/08*** | (2006.01) |
| ***G03G 15/16*** | (2006.01) |

(52) U.S. Cl.

CPC ..... *G03G 21/105* (2013.01); *G03G 15/0887* (2013.01); *G03G 15/0889* (2013.01); *G03G 15/0891* (2013.01); *G03G 15/0898* (2013.01); *G03G 15/161* (2013.01); *G03G 15/0877* (2013.01); *G03G 2215/1661* (2013.01)

(58) Field of Classification Search

CPC ..... G03G 21/105; G03G 15/0887; G03G 15/0889; G03G 15/0891; G03G 15/0898; G03G 15/161; G03G 2215/1661

See application file for complete search history.

(56) References Cited

U.S. PATENT DOCUMENTS

| | | | | |
|---|---|---|---|---|
| 6,832,067 | B2 * | 12/2004 | Kubo | G03G 21/105 399/350 |
| 7,447,468 | B2 * | 11/2008 | Nishimura | G03G 15/0893 399/254 |
| 9,235,159 | B2 * | 1/2016 | Sato | G03G 15/0879 |
| 2003/0234262 | A1 * | 12/2003 | Hart | G03G 21/12 222/233 |

(Continued)

FOREIGN PATENT DOCUMENTS

| | | | |
|---|---|---|---|
| JP | H03-160487 | A | 7/1991 |
| JP | H05-341649 | A | 12/1993 |
| JP | 2008-107613 | A | 5/2008 |

*Primary Examiner* — Ryan Walsh

(74) *Attorney, Agent, or Firm* — IP Business Solutions, LLC

(57) ABSTRACT

A cleaning device includes a toner storing container that stores a collected toner, a conveyance screw that conveys toner in the toner storing container, and a toner crushing member that crushes the toner accumulated in the toner storing container. The toner crushing member is formed so as to include: a supporting portion being attached above a rotation axis of the conveyance screw; and a plurality of elastic pieces each extending from the supporting portion toward the conveyance screw and being swung by a fin that rotates in association with the rotation of the conveyance screw. Each of the elastic pieces is formed with a raised portion rising toward the seal member, so that the elastic pieces come in contact with the seal member.

7 Claims, 11 Drawing Sheets

(56) References Cited

U.S. PATENT DOCUMENTS

| | | | | |
|---|---|---|---|---|
| 2006/0222408 | A1* | 10/2006 | Suenami | G03G 15/0822 399/254 |
| 2009/0257799 | A1* | 10/2009 | Haruno | G03G 21/12 399/360 |
| 2010/0143011 | A1* | 6/2010 | Tawada | G03G 21/007 399/358 |
| 2013/0108341 | A1* | 5/2013 | Ikebata | G03G 21/105 399/358 |
| 2014/0241751 | A1* | 8/2014 | Morishita | G03G 15/161 399/101 |
| 2014/0356043 | A1* | 12/2014 | Tokuda | G03G 21/105 399/358 |
| 2015/0063887 | A1* | 3/2015 | Asaoka | G03G 21/105 399/353 |
| 2015/0071691 | A1* | 3/2015 | Fujii | G03G 21/0029 399/350 |
| 2016/0342129 | A1* | 11/2016 | Matsumoto | G03G 21/0011 |
| 2017/0269511 | A1* | 9/2017 | Tomita | G03G 15/0889 |
| 2017/0293249 | A1* | 10/2017 | Okura | G03G 21/0011 |
| 2017/0343953 | A1* | 11/2017 | Oi | G03G 21/0011 |

* cited by examiner

CLEANING DEVICE AND IMAGE FORMING APPARATUS

INCORPORATION BY REFERENCE

This application claims priority to Japanese Patent Application No. 2016-148956 filed on 28 Jul., 2016, the entire contents of which are incorporated by reference herein.

BACKGROUND

The present disclosure relates to cleaning devices for removing remaining toner, and image forming apparatuses provided with the cleaning device.

Image forming apparatuses based on an electrophotographic method are widely known. The method includes five processes, namely, uniformly charging an uncharged photoconductor (charging process), irradiating the surface of the charged photoconductor with a laser beam according to a document to be copied thereby forming a latent image of the document on the surface of the photoconductor (exposure process), visualizing the latent image with toner (developing process), transferring the visualized toner image onto a recording medium such as a sheet placed on an intermediate transfer belt (transfer process), and fixing the transferred toner image onto the recording medium (fixing process).

Toner remains on the intermediate transfer belt on which the toner image has been transferred onto the recording medium, so that the remaining toner must be removed prior to the next image formation. Accordingly, for image forming apparatuses, various types of cleaning devices for removing the remaining toner have been suggested and been put into practice.

One example of the cleaning devices includes: a fur brush roller that cleans a surface of an intermediate transfer belt; a collecting roller that collects toner attached to the fur brush roller; a cleaning blade that abuts on a circumferential surface of the collecting roller and scrapes the toner collected by the collecting roller; and a toner storing container that temporally stores the toner scraped off by the cleaning blade.

The toner scraped off by the cleaning blade is moved to the toner storing container, and the toner moved to the toner storing container is conveyed by a conveyance screw to outside of the cleaning device. There is another example of the cleaning devices in which a seal member with flexibility is provided so as to make contact with a surface of the collecting roller, to thereby suppress the toner scraped off by the cleaning blade from flowing back to a fur brush roller side.

SUMMARY

A technique improved over the above technique is proposed herein as an aspect of the present disclosure.

A cleaning device according to an aspect of the present disclosure includes a removing roller, a collecting roller, a cleaning blade, a toner storing container, a conveyance screw, and a toner crushing member. The removing roller removes toner remaining on an image carrier while rotating in contact with the image carrier around a first rotation axis extending in a width direction of the image carrier. The collecting roller collects toner attached on the removing roller from the removing roller while making contact with the removing roller and rotating around a second rotation axis that is parallel with an extending direction of the first rotation axis. The cleaning blade extends in parallel with an extending direction of the second rotation axis, makes contact with the collecting roller, and scrapes off toner attached on the collecting roller. The toner storing container stores the toner having been collected by the collecting roller and scraped off by the cleaning blade, and is partitioned from the removing roller and the collecting roller by a seal member extending in parallel with the first rotation axis and the second rotation axis. The conveyance screw is disposed in the toner storing container, and, by rotating around a third rotation axis extending in parallel with the extending direction of the first rotation axis, conveys toner to an extending direction of the third rotation axis with a spirally formed fin provided on the conveyance screw around the third rotation axis. The toner crushing member crushes the toner accumulated in the toner storing container. Additionally, the toner crushing member includes a supporting portion and a plurality of elastic pieces. The supporting portion extends in parallel with the extending direction of the third rotation axis and is attached above the conveyance screw. The plurality of elastic pieces extends from the supporting portion toward the conveyance screw and is swung by making contact with the fin that rotates in association with the rotation of the conveyance screw. Each of the elastic pieces is formed with a base end portion at a side of the supporting portion. The base end portion is formed narrower than a pitch of adjacent two fin parts of the fin and formed so as to be fitted between intervals of the adjacent two fin parts in the extending direction of the third rotation axis. Also, each of the elastic pieces is formed with a raised portion rising toward the seal member, and as the raised portion is swung by making contact with the fin, the elastic pieces vibrate the seal member.

An image forming apparatus according to another aspect of the present disclosure includes an image forming section including an image carrier and the above described cleaning device. The cleaning device removes toner remaining on the image carrier.

DETAILED DESCRIPTION

Figure 1:
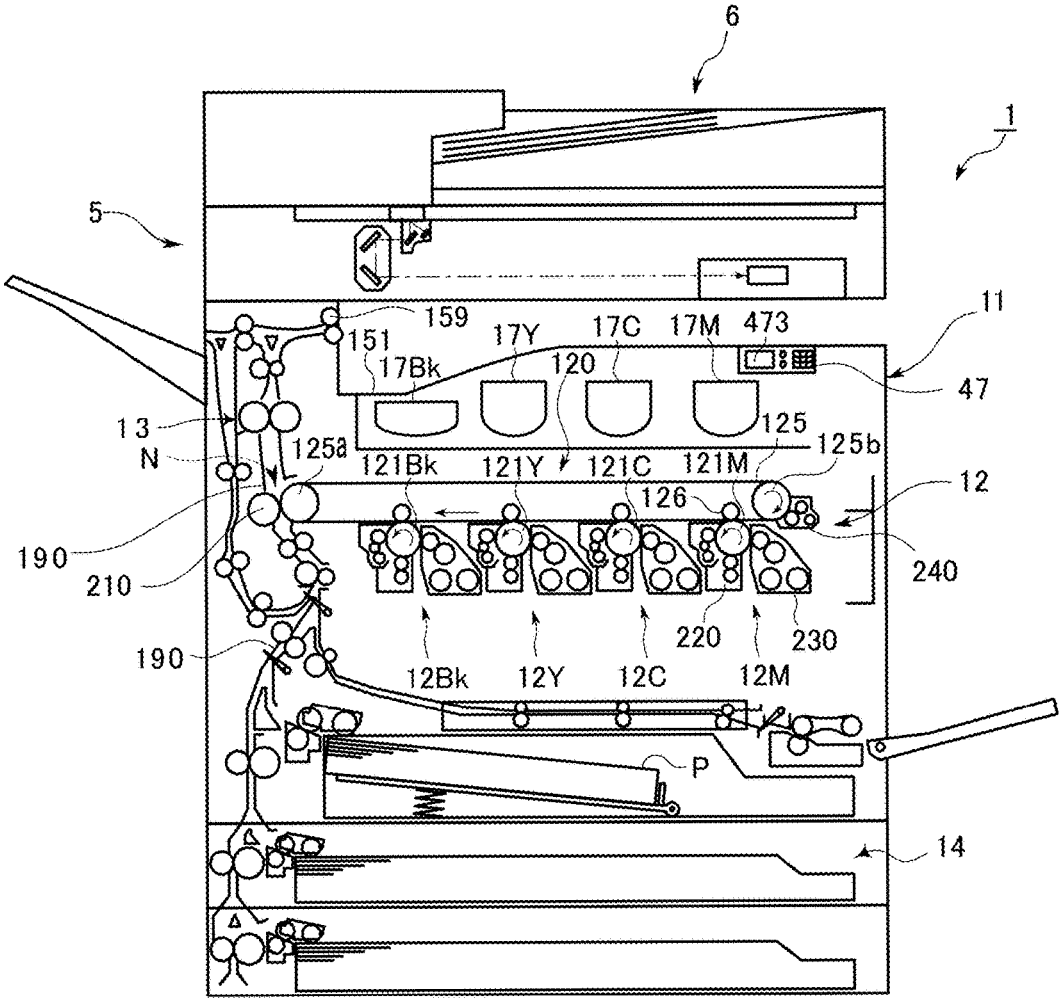
FIG. 1 is a schematic partial front sectional view showing structure of an image forming apparatus according a first embodiment of the present disclosure.

Hereinafter, a description will be given of a cleaning device according to the present disclosure and an image forming apparatus including the cleaning device, with reference to the drawings. FIG. 1 is a schematic partial front sectional view showing structure of the image forming apparatus according a first embodiment of the present disclosure. The image forming apparatus 1 is a multifunction peripheral having a plurality of functions, such as copying, printing, scanning, and facsimile transmission, and includes an apparatus body 11 having an operation section 47, a document feeder 6, a document reading section 5, an image forming section 12, a fixing section 13, and a paper feed tray 14.

The operation section 47 receives, from an operator, instructions such as an image forming operation execution instruction and a document reading operation execution instruction for various kinds of operation and processing executable by the image forming apparatus 1. The operation section 47 includes a display section 473 for displaying operation guides for the operator.

A description will be given in performing the image forming operation by the image forming apparatus 1. Based on, for example, the image data generated through the document reading operation, the image data stored in the built-in HDD, or the image data received from the network-connected computer, the image forming section 12 forms a toner image on recording paper P as a recording paper sheet (recording medium) fed from the paper feed tray 14.

The image forming section 12 includes an image forming unit 12Bk for black (Bk), an image forming unit 12Y for yellow (Y), an image forming unit 12C for cyan (C), and an image forming unit 12M for magenta (M). Each of the image forming units 12Bk, 12Y, 12C, and 12M includes: drum type photoconductors 121Bk, 121Y, 121C, and 121M respectively; a charging device 220 that charges each surface of the photoconductors 121Bk, 121Y, 121C, and 121M; and a developing device 230 that forms the toner image on the photoconductors 121Bk, 121Y, 121C, and 121M. Each of the photoconductors 121Bk, 121Y, 121C, and 121M is configured so as to be rotatably driven in counterclockwise in FIG. 1.

Toner containers 17Bk, 17Y, 17C, and 17M stores a toner for black, a toner for yellow, a toner for cyan, and a toner for magenta, respectively, and is detachably attached to a toner container mounting member (not illustrated) mounted on the apparatus body 11, at a position away from the photoconductors 121Bk, 121Y, 121C, and 121M with an intermediate transfer belt 125 (one example of the image carrier) in between, the position being above of the intermediate transfer belt 125.

A transfer unit 120 includes: the intermediate transfer belt 125 onto an outer circumferential surface of which the toner image is transferred; a drive roller 125*a*; a driven roller 125*b*; a primary transfer roller 126; and a cleaning device 240 that removes toner remaining on a surface of the intermediate transfer belt 125.

The intermediate transfer belt 125 is stretched between the drive roller 125*a* and the driven roller 125*b*, is driven by the drive roller 125*a* while abutting on circumferential surfaces of the photoconductors 121Bk, 121Y, 121C, and 121M, and endlessly runs synchronously with the photoconductors 121Bk, 121Y, 121C, and 121M.

A description will be given in performing color printing. Surroundings of the photoconductors 121Bk, 121Y, 121C, and 121M are evenly charged (charging process), a laser light is irradiated to surfaces of the electrically charged photoconductors 121Bk, 121Y, 121C, and 121M based on image data to form latent images (exposure process), and the latent images visualized by toner (developing process). Then the toner images formed through the visualization are transferred onto the intermediate transfer belt 125 by the primary transfer roller 126.

The toner images of the respective colors (black, yellow, cyan, and magenta) to be transferred onto the intermediate transfer belt 125 are superposed on each other on the intermediate transfer belt 125 through transfer timing adjustment, turning into a color toner image.

A secondary transfer roller 210 transfers, at a nip part N, the color toner image having been formed on the surface of the intermediate transfer belt 125 onto the recording paper P conveyed from the paper feed tray 14 through a conveyance path 190. The nip part N is formed between the secondary transfer roller 210 and the drive roller 125*a* with the intermediate transfer belt 125 in between.

The fixing section 13 fixes the toner image on the recording paper P through thermal compression. The recording paper P on which the color image has been formed and subjected to fixing processing is discharged onto a discharge tray 151.

Figure 2:
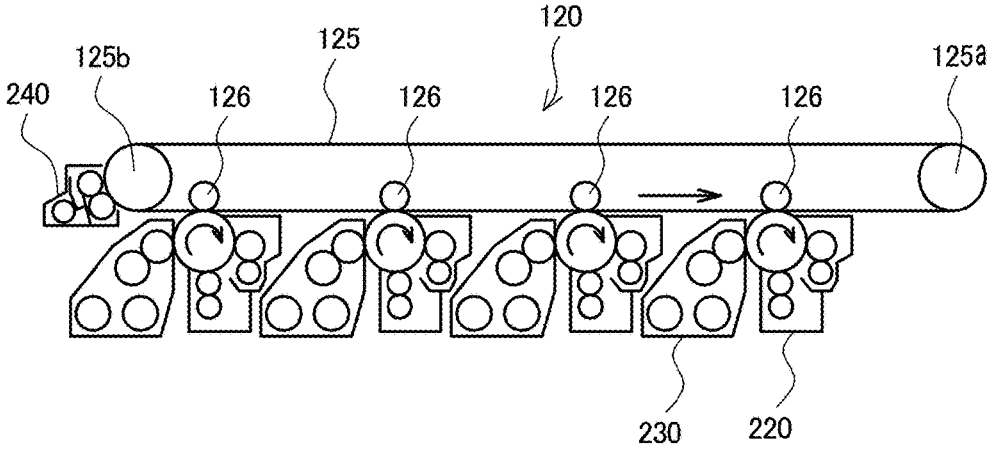
FIG. 2 is a sectional view showing a transfer unit and its peripheral configuration.
Figure 3:
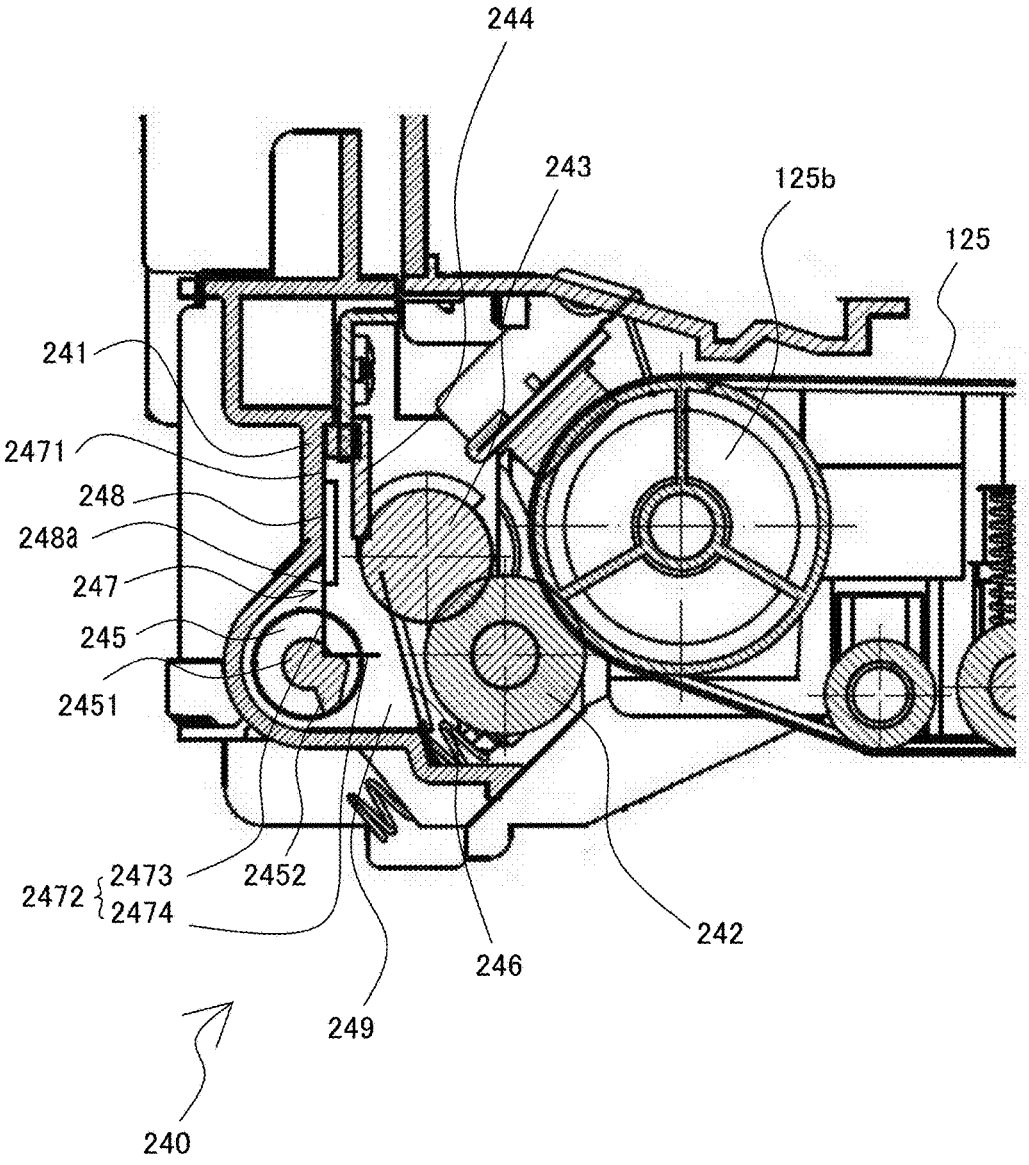
FIG. 3 is a sectional view showing a cleaning device and its peripheral configuration.
Figure 4:
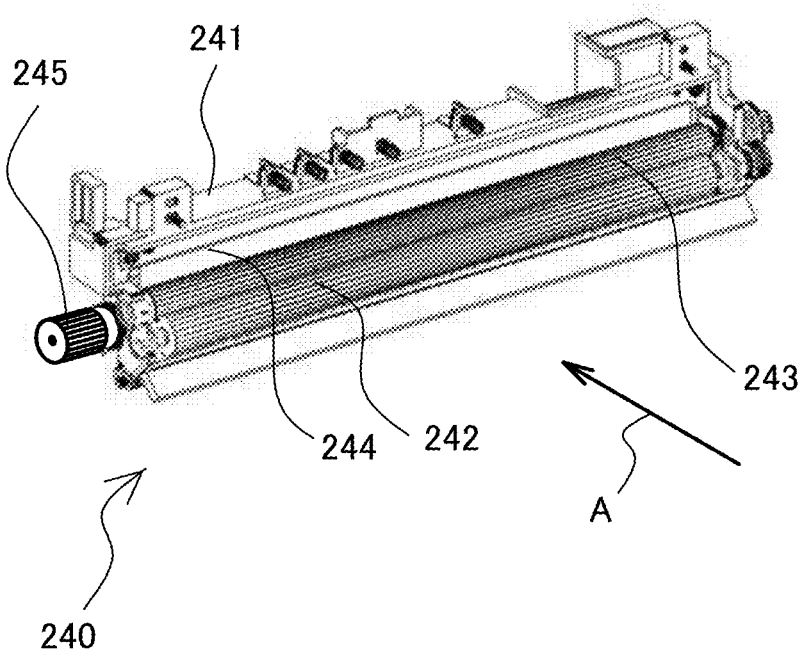
FIG. 4 is a perspective view showing a configuration of the cleaning device.
Figure 5:
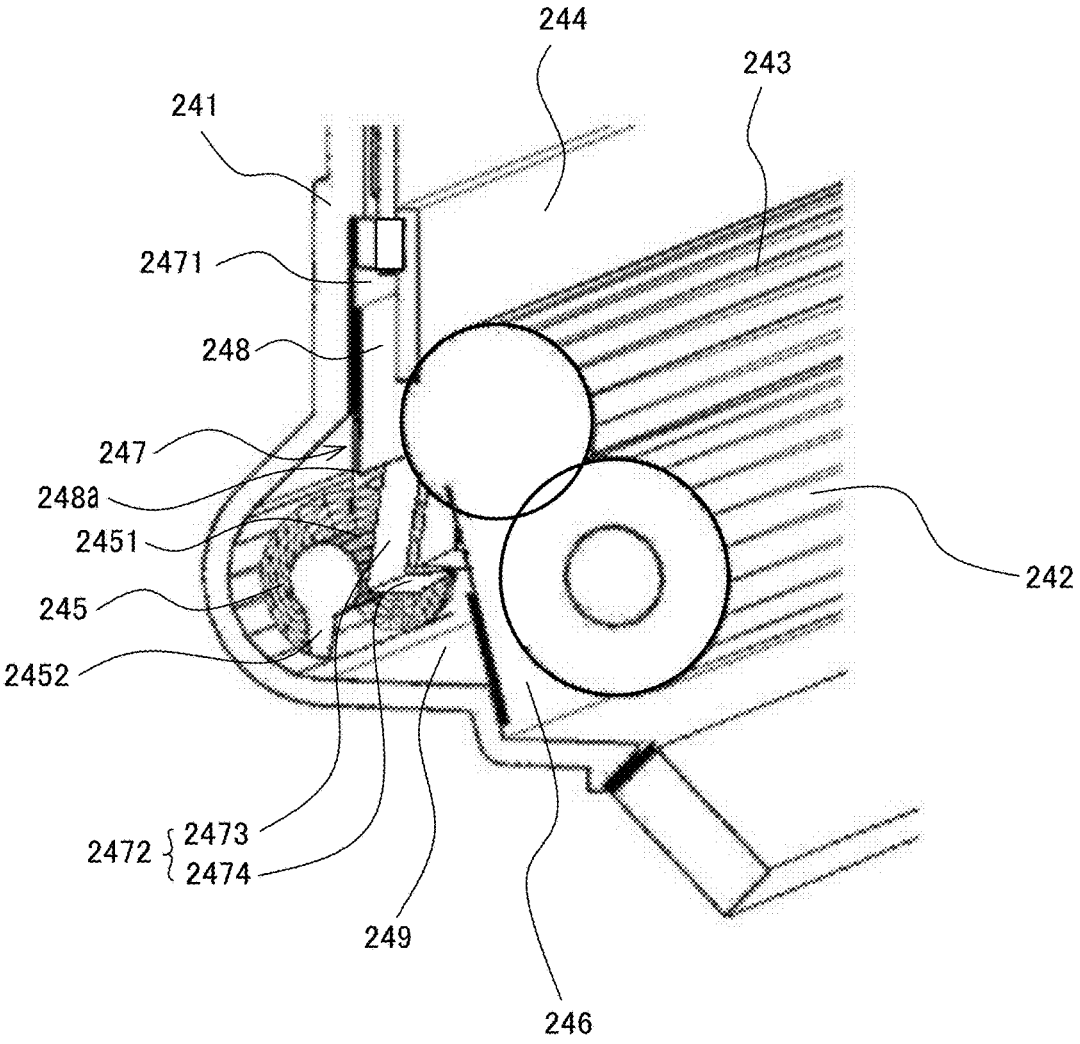
FIG. 5 is a partial perspective sectional view showing the configuration of the cleaning device.
Figure 6:
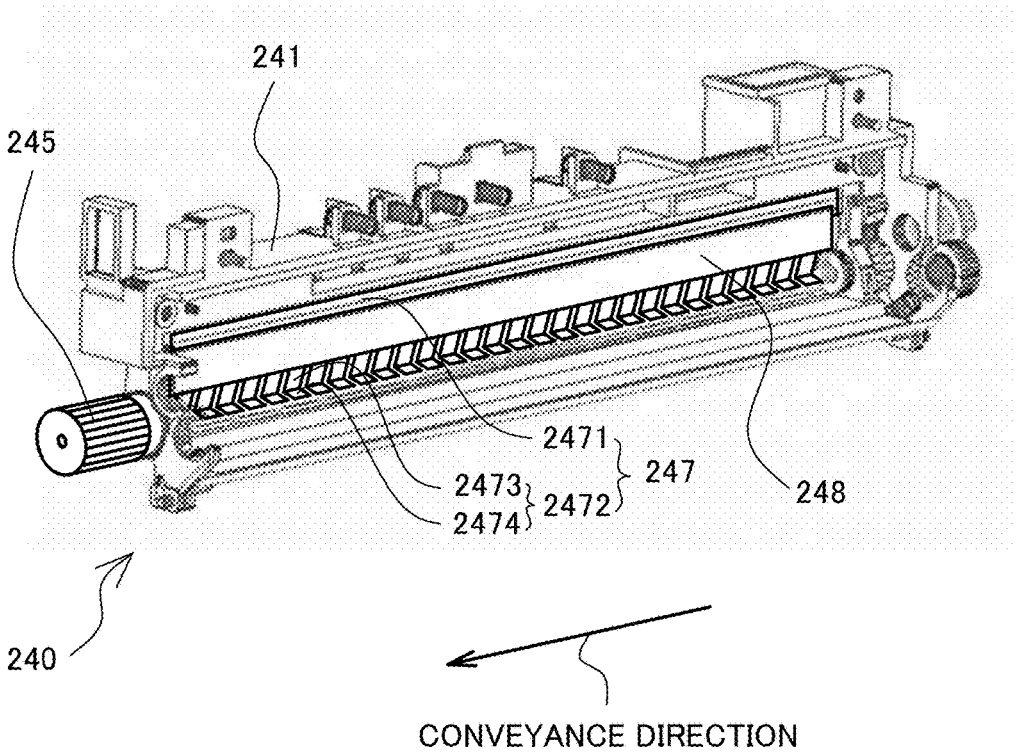
FIG. 6 is a view showing the cleaning device from which a fur brush roller and a collecting roller are removed.
Figure 7A:
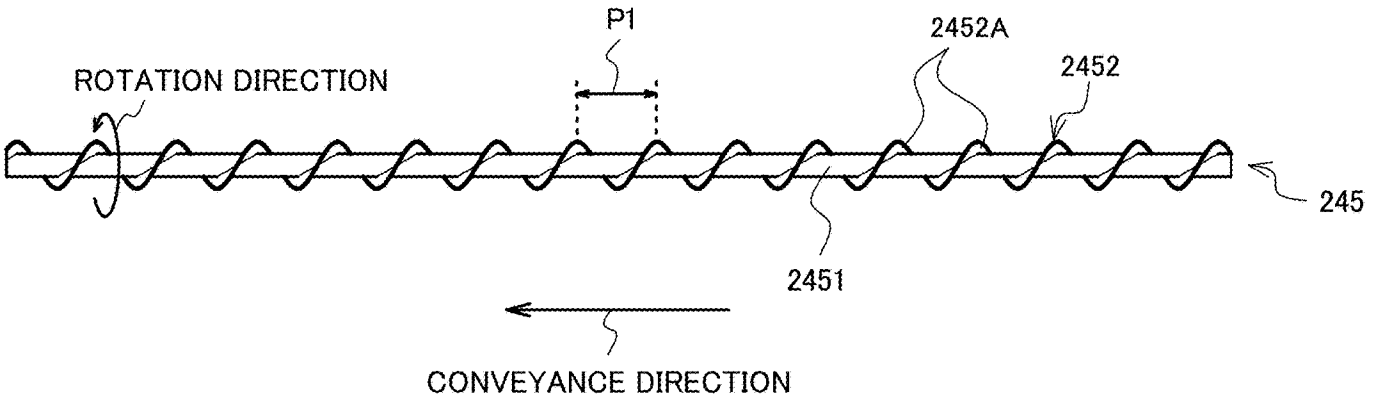
FIG. 7A is a view showing a conveyance screw and FIG. 7B is a view showing a toner crushing member.
Figure 7B:
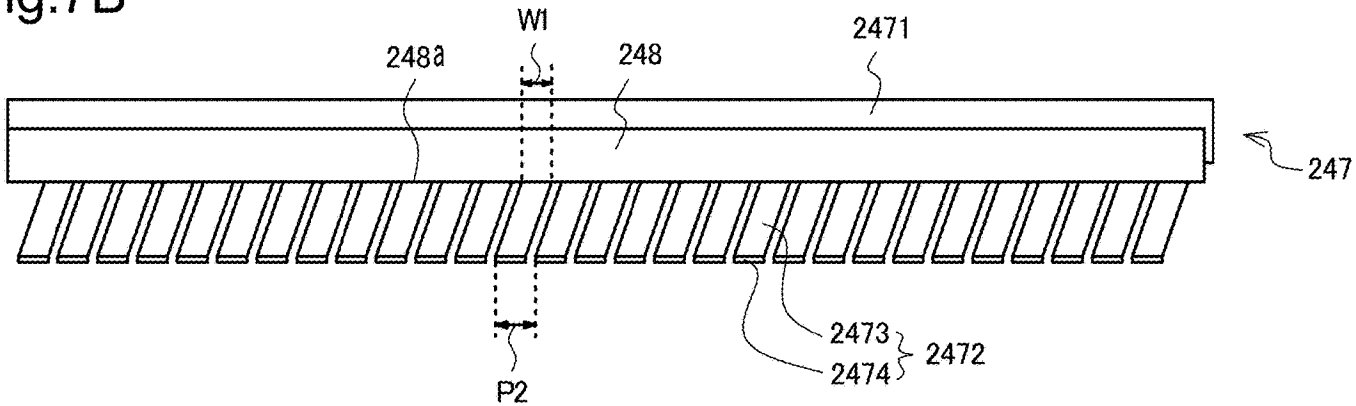
Figure 8A:
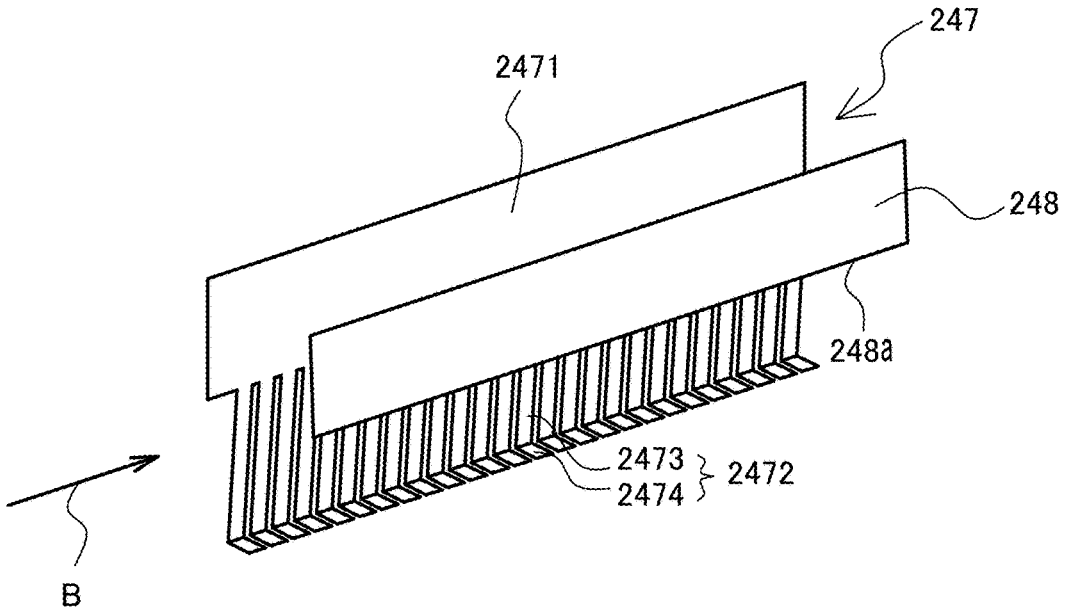
FIG. 8A is a perspective view showing the toner crushing member and a swing support shaft adjustment sheet when they are unattached to one another.
Figure 8B:
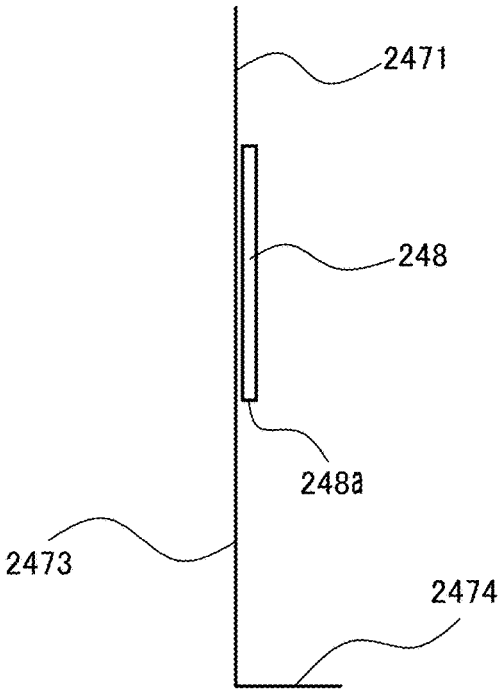
FIG. 8B is a view showing the toner crushing member to which the swing support shaft adjustment sheet is attached.

FIG. 2 is a sectional view showing the transfer unit 120 and its peripheral configuration, as viewed from the back side of the image forming apparatus 1 illustrated in FIG. 1. FIG. 3 is a sectional view showing the cleaning device 240 and its peripheral configuration, as viewed from the back side of the image forming apparatus 1 illustrated in FIG. 1. FIG. 4 is a perspective view showing a configuration of the cleaning device 240 and FIG. 5 is a partial perspective sectional view showing the configuration of the cleaning device 240. FIG. 6 is a view showing the cleaning device 240 from which a fur brush roller 242 and a collecting roller 243 are removed, as viewed from the direction indicated as A in FIG. 4. FIG. 7A is a view showing a conveyance screw 245 and FIG. 7B is a view showing a toner crushing member 247. FIG. 8A is a perspective view showing the toner crushing member 247 and a swing support shaft adjustment sheet 248 when they are unattached to one another, and FIG. 8B is a view showing the toner crushing member 247 to which the swing support shaft adjustment sheet 248 is attached by a double-sided tape, as viewed from the direction indicated as B in FIG. 8A.

The cleaning device 240 includes a casing 241, to which the fur brush roller 242, the collecting roller 243, a cleaning blade 244, the conveyance screw 245, a seal member 246, the toner crushing member 247, and the swing support shaft adjustment sheet 248, that constitute the cleaning device 240, are attached. The casing 241 includes a toner storing container 249. A disposed position of the toner storing container 249 is, for example, the lower left corner in FIG. 3.

The fur brush roller 242 is arranged so as to face the driven roller 125*b* with the intermediate transfer belt 125 in between. The fur brush roller 242 cleans the surface of the intermediate transfer belt 125 while rotating in contact with the intermediate transfer belt 125 and electrically attracts toner remaining on the surface of the intermediate transfer belt 125. The fur brush roller 242 is formed by having, for example a nonwoven fabric comprising a filament made of resin, wound around whole of its rotation axis. The rotation axis of the fur brush roller 242 (a first rotation axis) extends in parallel with the driven roller 125*b* that is a width direction of the intermediate transfer belt 125, and is pivotally supported by the casing 241. The fur brush roller 242 is one example of a removing roller in the scope of the claims.

The collecting roller 243 is made of, for example, metal. The collecting roller 243 makes contact with the surface of the fur brush roller 242 and electrically collects, from the fur brush roller 242, the toner having been collected by the fur brush roller 242. A rotation axis of the collecting roller 243 (a second rotation axis) extends in parallel with the fur brush roller 242 and is pivotally supported by the casing 241.

The cleaning blade 244 is constituted of a flat plate member, and extends in parallel with the collecting roller 243. The cleaning blade 244 is attached to the casing 241 in a manner such that a tip thereof touches the surface of the collecting roller 243, and scrapes off the toner having been collected by the collecting roller 243 from the surface of the collecting roller 243. The scraped off toner drops into the toner storing container 249 and remains therein.

The toner storing container 249 is partitioned from the fur brush roller 242 and the collecting roller 243 by the seal member 246, and stores the toner having been collected by the collecting roller 243 and scraped off by the cleaning blade 244. The toner storing container 249 includes the conveyance screw 245.

The conveyance screw 245 extends in parallel with the collecting roller 243, and its rotation axis 2451 (a third rotation axis) is pivotally supported by the casing 241. A fin 2452 formed in a spiral shape for conveying the toner is arranged on a circumferential surface of the rotation axis 2451 of the conveyance screw 245. The fin 2452 rotates around the rotation axis 2451 so that the conveyance screw 245 conveys the toner to a direction that the rotation axis 2451 extends. The toner having been conveyed in this manner moves to a waste toner tank (not illustrated) through an un-illustrated opening portion provided at the toner storing container 249.

The seal member 246 is a sheet-like member and made of, for example, materials having flexibility such as urethane. A part of the seal member 246 is attached to the toner storing container 249 so as to flexibly touch the surface of the collecting roller 243. The seal member 246 is arranged so that the toner attached to the surface of the collecting roller 243 can pass through the position where a tip of the seal member 246 touches the surface of the collecting roller 243 but the toner scraped off from the collecting roller 243 by the cleaning blade 244 is stopped from flowing back to the fur brush roller 242 side from the toner storing container 249.

The toner crushing member 247 crushes the toner accumulated in the toner storing container 249. The toner crushing member 247 is fixed to an inner wall of the casing 241 and extends toward the direction that the rotation axis 2451 of the conveyance screw 245 extends. The toner crushing member 247 is made up to include a supporting portion 2471 arranged above the rotation axis 2451 of the conveyance screw 245 in parallel with the rotation axis 2451, and a plurality of elastic pieces 2472 extending from the supporting portion 2471 to the conveyance screw 245. The toner crushing member 247 is made of, for example, a synthetic resin material having flexibility. With the synthetic resin material having flexibility, the toner crushing member 247 is capable of easily crushing the toner accumulated in the toner storing container 249.

The elastic pieces 2472 are swung by making contact with the fin 2452 that rotates in association with the rotation of the conveyance screw 245. Each of the elastic pieces 2472 includes a base end portion 2473 formed at a side of the supporting portion 2471. A width W1 (illustrated in FIG. 7B) of the base end portion 2473 is designed so as to be narrower than a width that is calculated by deducting thickness of adjacent two fin parts 2452A of the fin 2452, the fin 2452 being provided along the extending direction of the rotation axis 2451, from width of a pitch P1 (illustrated in FIG. 7A) of the adjacent two fin parts 2452A of the fin 2452. Thus, the base end portion 2473 can be fitted between the adjacent two fin parts 2452A of the fin 2452. As illustrated in FIG. 8A, each of the elastic pieces 2472 includes a raised portion 2474 rising toward the seal member 246, thus the elastic pieces 2472 can touch the seal member 246. Considering the strength, 90 degrees is a desirable angle to be formed between the base end portion 2473 and the raised portion 2474. It is not intended, however, to limit the angle between the base end portion 2473 and the raised portion 2474 to be the aforementioned angle.

The elastic pieces 2472 abut on the conveyance screw 245 and swing in association with the rotation of the conveyance screw 245. In other words, when the conveyance screw 245 rotates, the elastic pieces 2472 ride over the fin 2452 as the fin 2452 moves in association with the rotation of the conveyance screw 245 (relative positional movement against the elastic pieces 2472), and then fit into intervals between adjacent two fin parts 2452A of the fin 2452. Accordingly, the elastic pieces 2472 swing between the conveyance screw 245 and the seal member 246. The elastic pieces 2472 crash, by this swing, the waste toner piled up within the toner storing container 249.

In addition, by the above described swing, the elastic pieces 2472 repeat moving between a position where the raised portion 2474 becomes in contact with the seal member 246 and a position where the raised portion 2474 becomes in non-contact with the seal member 246. The elastic pieces 2472 and the raised portion 2474 vibrate the seal member 246 with a help of the aforesaid movement. By this vibration, the elastic pieces 2472 inhibit foreign objects from being bitten in between the collecting roller 243 and seal member 246, and make the bitten foreign objects be dropped.

In this embodiment, a pitch P2 (illustrated in FIG. 7B) of the elastic pieces 2472 is a half of the pitch P1 of the fin parts 2452A, and two of the elastic pieces 2472 are arranged at each pitch between the adjacent two fin parts 2452A. With this arrangement, when the conveyance screw 245 starts to rotate, the two of the elastic pieces 2472 initially arranged at the pitch P1 in the extending direction of the rotation axis 2451 move to the direction toward the seal member 246 by a pressure from the fin 2452, and the raised portion 2474 makes contact with the seal member 246. At this time, another two of the elastic pieces 2472 that are to be arranged at the pitch P1 next do not receive the pressure from the fin 2452, and are arranged to be located at a non-contacting position with the seal member 246. It is not intended, however, to limit the number of the elastic pieces 2472 arranged at pitch P1 to the aforementioned number.

When the conveyance screw 245 further rotates, the another two of the elastic pieces 2472 that are to be arranged at the pitch P1 next move to the direction toward the seal member 246 by the pressure from the fin 2452, and the raised portion 2474 of the elastic pieces 2472 makes contact with the seal member 246. At this time, the two of the elastic pieces 2472 initially arranged at the pitch P and the elastic pieces 2472 formed there at are released from the pressure from the fin 2452 and go back to the non-contacting position with the seal member 246.

The toner crushing member 247 is formed desirably with material firmer than the seal member 246. For example, a dilute resin sheet around 100 μm such as PET (polyethylene terephthalate) is used.

A screw direction of the conveyance-screw is left hand (i.e., connecting the lower left side to the upper right side). When viewing the rotation axis 2451 from the right side in FIG. 7A, the conveyance screw rotates clockwise, so that the direction toward the left side in FIG. 7A is a conveyance direction of the toner.

As illustrated in FIG. 8A and FIG. 8B, at a border between the supporting portion 2471 and the elastic pieces 2472 of the toner crushing member 247, the swing support shaft adjustment sheet 248 is attached. The swing support shaft adjustment sheet 248 serves as a member for adjusting a swing support shaft for the elastic pieces 2472 to be a bottom end portion 248*a* of the swing support shaft adjustment sheet 248. The swing support shaft is a base shaft when the elastic pieces 2472 are swung by the rotation of the conveyance screw 245 (the pressure from the fin 2452). In other words, the swing support shaft adjustment sheet 248 is capable of setting a swing range of the elastic pieces 2472 to be narrow, by shortening the length of the elastic pieces 2472 extending toward the conveyance screw 245 from the bottom end portion 248*a* of the swing support shaft adjustment sheet 248. With this arrangement, it is possible to adjust a power that the elastic pieces 2472 scrape off toner and a power to vibrate the seal member 246 (i.e., the amount that the raised portion 2474 moves the seal member 246 by its pressure). A sheet thicker than the toner crushing member 247, for example, a resin sheet around 250 μm such as PET (polyethylene terephthalate) is used for the swing support shaft adjustment sheet 248.

In general image forming apparatuses, an intermediate transfer belt makes contact with a recording medium, so that sometimes foreign objects such as paper powder flow into a cleaning device along with toner. When the foreign objects that flew into the cleaning device along with the toner are bitten in between a collecting roller and a seal member, a gap appears between the collecting roller and the seal member, which causes the toner in a toner storing container to flow back into the intermediate transfer belt. In the worst case, there is an occurrence of a phenomenon called toner drop, in which the recording medium is stained.

In contrast, in the embodiment of the present disclosure, when the conveyance screw 245 rotates, the plurality of the elastic pieces 2472 of the toner crushing member 247 is swung by the fin 2452 provided on the conveyance screw 245, and in association with the swing, a contact and non-contact are repeated by the raised portion 2474 formed respectively at the elastic pieces 2472 with respect to the seal member 246. Thus, the elastic pieces 2472 can vibrate the seal member 246. This vibration inhibits foreign objects from being bitten in between the collecting roller 243 and the seal member 246, and makes the bitten foreign objects be dropped. That is, the embodiment is capable of suppressing situations such that the foreign objects get in between the collecting roller 243 and the seal member 246, and eliminating such situations promptly. Furthermore, it is possible to accurately prevent a gap from appearing between the collecting roller 243 and the seal member 246.

Figure 9A:
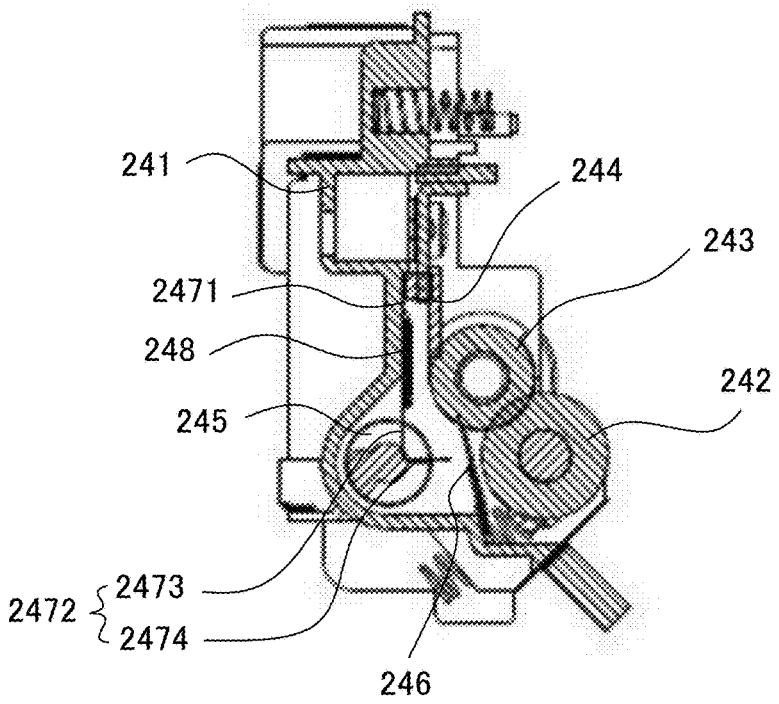
FIG. 9A is a view showing a state in which elastic pieces are fitted between intervals of adjacent two fin parts of a fin provided on the conveyance screw.
Figure 9B:
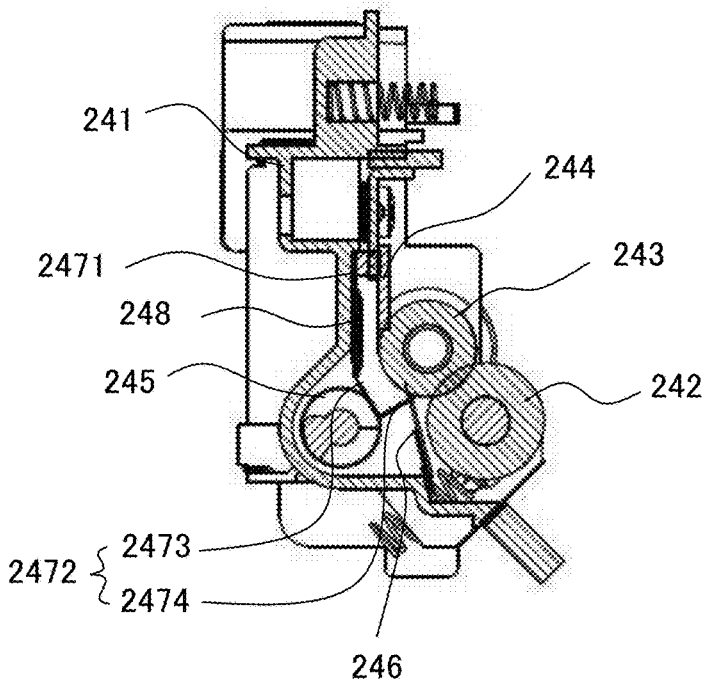
FIG. 9B is a view showing a state in which the elastic pieces ride over the fin provided on the conveyance screw.

FIG. 9A is a view showing a state in which the elastic pieces 2472 are fitted between intervals of the adjacent two fin parts 2452A of the fin 2452 provided on the conveyance screw 245 (within the aforesaid pitch P1) (minimum movable position of swing range), and FIG. 9B is a view showing a state in which the elastic pieces 2472 ride over the fin 2452 provided on the conveyance screw 245 (maximum movable position of swing range).

When the conveyance screw 245 rotates, the plurality of elastic pieces 2472 is swung by the fin 2452 provided on the conveyance screw 245, as described above. When the swing is made, the elastic pieces 2472 perform movement for fitting into intervals of the adjacent two fin parts 2452A of the fin 2452, as illustrated in FIG. 9A, and perform movement of riding over the fin 2452, as illustrated in FIG. 9B. The raised portion 2474 formed respectively at the elastic pieces 2472 makes contact with the seal member 246 at the time of the riding-movement, and becomes non-contact with the seal member 246 at the time of the fitting-movement.

Figure 10A:
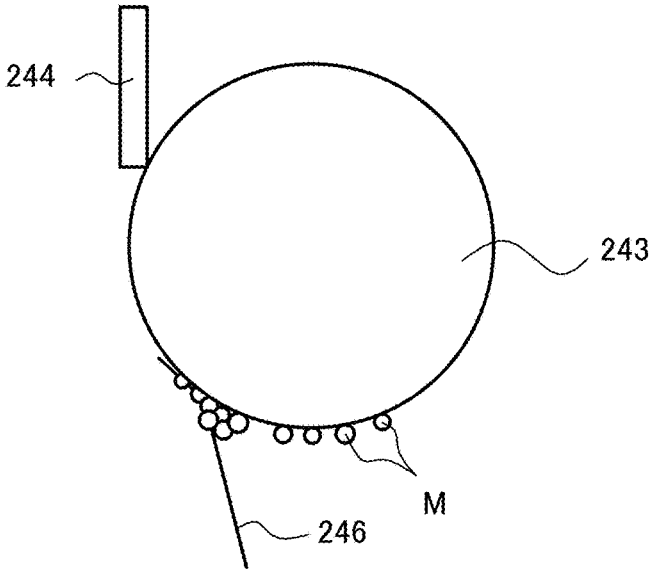
FIG. 10A is a view schematically showing a state in which paper powder is bitten between the collecting roller and a seal member.
Figure 10B:
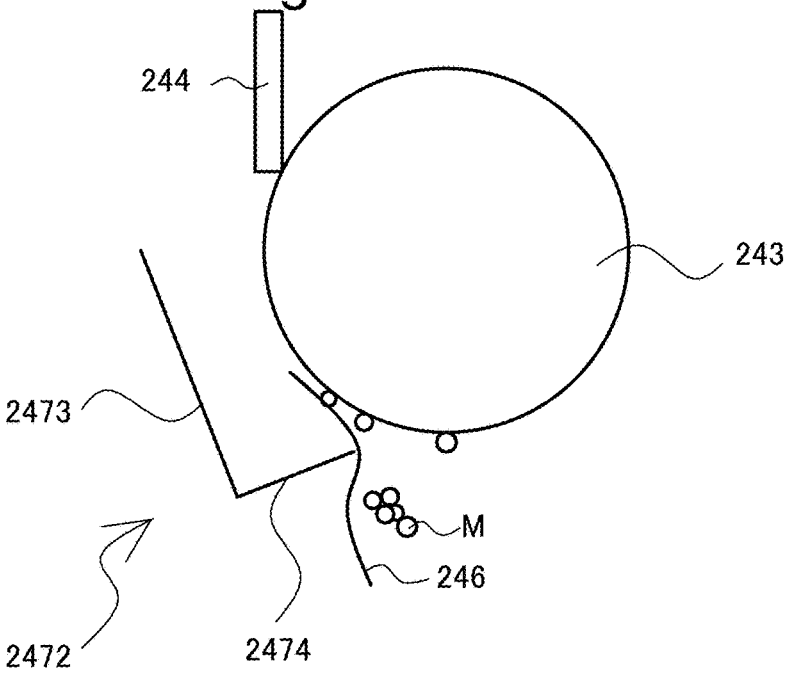
FIG. 10B is a view schematically showing a state in which the paper powder is falling off.

FIG. 10A is a view schematically showing a state in which paper powder M is bitten between the collecting roller 243 and the seal member 246, and FIG. 10B is a view schematically showing a state in which the paper powder M is falling off. When the raised portion 2474 of the elastic pieces 2472, which comprises the toner crushing member 247, comes in contact with the seal member 246 and the seal member 246 vibrates, the paper powder M falls off, as illustrated in FIG. 10B.

The embodiment above has been describing the case in which the plurality of the elastic pieces 2472 is arranged at each pitch between the adjacent two fin parts of the fin 2452, but a single elastic piece 2472 may be arranged between each pitch.

Figure 11:
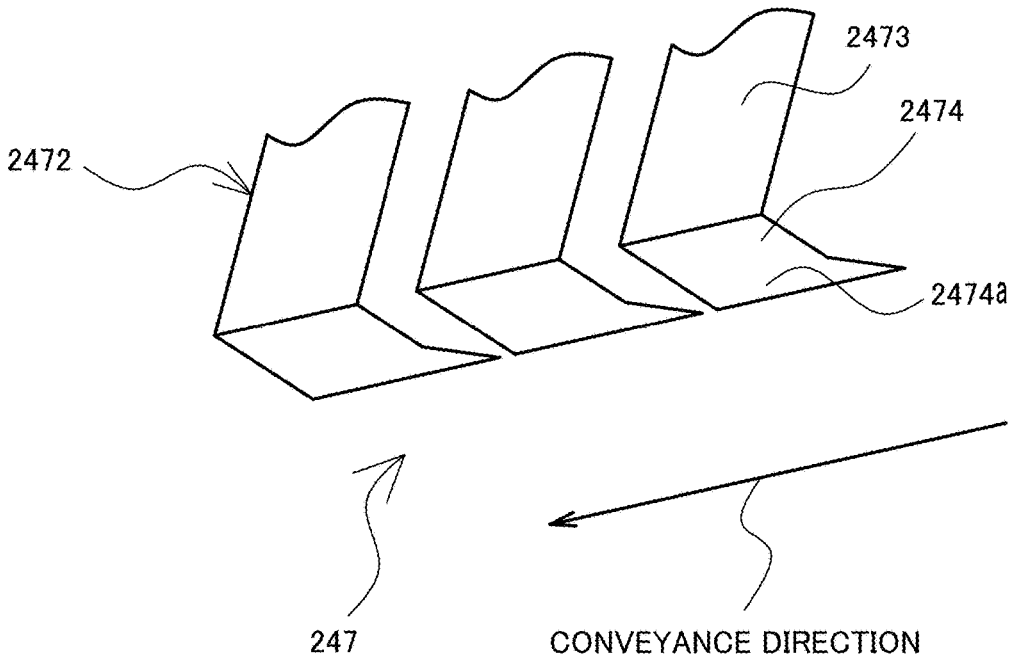
FIG. 11 is a perspective view showing elastic pieces according to a second embodiment of the present disclosure.

In another embodiment, as illustrated in FIG. 11, the elastic pieces 2472 comprising the toner crushing member 247 may be formed such that a tip portion 2474*a* of the raised portion 2474 protrudes at an upstream side (or downstream side) in the conveyance direction, forming an L shape, and may be formed widely within limits keeping the tip portion 2474*a* from contacting with the adjoining tip portion 2474*a*. With this arrangement, an area where the raised portion 2474 and the seal member 246 come in contact is widened, and the power to vibrate the seal member 246 can be enlarged. Thus, it is possible to more effectively prevent a gap from appearing between the collecting roller 243 and the seal member 246.

The present disclosure is not limited to the embodiments described above and various modifications thereto can be made. In the above, described as one embodiment of the image forming apparatus according to the present disclosure is a multifunction peripheral, but it is merely an example. Different electronic devices, for example another image forming apparatus having functions such as a copy function, a facsimile function, and a printing function, may be used.

Further, the configurations and processes of the embodiment described with reference to FIGS. 1 to 11 are merely exemplary, and not intended to limit the scope of the disclosure.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A cleaning device comprising:

a removing roller that removes toner remaining on an image carrier while rotating in contact with the image carrier around a first rotation axis extending in a width direction of the image carrier;

a collecting roller that collects toner attached on the removing roller from the removing roller while making contact with the removing roller and rotating around a second rotation axis that is parallel with an extending direction of the first rotation axis;

a cleaning blade that extends in parallel with an extending direction of the second rotation axis, makes contact with the collecting roller, and scrapes off toner attached on the collecting roller;

a toner storing container that stores the toner having been collected by the collecting roller and scraped off by the cleaning blade, and is partitioned from the removing roller and the collecting roller by a seal member extending in parallel with the first rotation axis and the second rotation axis;

a conveyance screw that is disposed in the toner storing container, and, by rotating around a third rotation axis extending in parallel with the extending direction of the first rotation axis, conveys toner to an extending direction of the third rotation axis with a spirally formed fin provided on the conveyance screw around the third rotation axis ; and a toner crushing member that crushes the toner accumulated in the toner storing container, wherein the toner crushing member includes a supporting portion and a plurality of elastic pieces, the supporting portion extending in parallel with the extending direction of the third rotation axis and being attached above the conveyance screw, the plurality of elastic pieces extending from the supporting portion toward the conveyance screw and being swung by making contact with the fin that rotates in association with the rotation of the conveyance screw, each of the elastic pieces is formed with a base end portion at a side of the supporting portion, the base end portion being formed narrower than a pitch of adjacent two fin parts of the fin and formed so as to be fitted between intervals of the adjacent two fin parts in the extending direction of the third rotation axis, and each of the elastic pieces is formed with a raised portion rising toward the seal member, and as the raised portion is swung by making contact with the fin, the elastic pieces vibrate the seal member.

2. The cleaning device according to claim 1, wherein the raised portion formed respectively at the elastic pieces is swung by making contact with the fin, and repeats moving between a position where the raised portion is in contact with the seal member and a position where the raised portion is in non-contact with the seal member, to thereby vibrate the seal member.

3. The cleaning device according to claim 1, wherein the plurality of elastic pieces is arranged between each pitch of adjacent two fin parts of the fin.

4. The cleaning device according to claim 1, wherein a tip portion of the raised portion is formed wider than the base end portion.

5. The cleaning device according to claim 1, wherein the toner crushing member is made of a synthetic resin material having flexibility.

6. The cleaning device according to claim 1, wherein the base end portion and the raised portion in each of the plurality of elastic pieces form an angle of 90 degree.

7. An image forming apparatus comprising:

an image forming section including an image carrier; and the cleaning device according to claim 1, wherein the cleaning device removes toner remaining on the image carrier.

* * * * *